US011293250B2

(12) United States Patent
Ganzinotti, III et al.

(10) Patent No.: US 11,293,250 B2
(45) Date of Patent: Apr. 5, 2022

(54) METHOD AND APPARATUS FOR FRACKING AND PRODUCING A WELL

(71) Applicant: Cameron International Corporation, Houston, TX (US)

(72) Inventors: Edward Ganzinotti, III, Houston, TX (US); Pheng Aun Soh, Houston, TX (US); Brandon Blake Shirley, Cypress, TX (US); Craig Cotton, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 135 days.

(21) Appl. No.: 16/375,854

(22) Filed: Apr. 5, 2019

(65) Prior Publication Data

US 2019/0309597 A1 Oct. 10, 2019

Related U.S. Application Data

(60) Provisional application No. 62/653,719, filed on Apr. 6, 2018.

(51) Int. Cl.
*E21B 33/068* (2006.01)
*E21B 34/02* (2006.01)
(Continued)

(52) U.S. Cl.
CPC ..... *E21B 33/068* (2013.01); *E21B 21/002* (2013.01); *E21B 21/10* (2013.01); *E21B 34/02* (2013.01); *E21B 34/16* (2013.01)

(58) Field of Classification Search
CPC ..... E21B 33/068; E21B 34/02; E21B 21/10; E21B 21/002; E21B 34/16
See application file for complete search history.

(56) References Cited

U.S. PATENT DOCUMENTS 8,302,678 B2 11/2012 Swagerty et al.
2001/0050172 A1* 12/2001 Tolman ..... E21B 17/203 166/297

(Continued)

OTHER PUBLICATIONS

International Search Report and Written Opinion for the International patent application PCT/US2019/025938 dated Sep. 11, 2019.

(Continued)

*Primary Examiner* — Steven A MacDonald
(74) *Attorney, Agent, or Firm* — Helene Raybaud

(57) ABSTRACT

A technique facilitates performance of well operations. According to an embodiment, the technique employs a modular assembly configured for coupling with a wellhead assembly. The modular assembly may have a production subassembly and a fracturing subassembly. By way of example, the production subassembly may comprise a connection block positioned for coupling to the wellhead assembly, a production outlet fluidly connected to the connection block, and a valve between the connection block and the production outlet. Additionally, the fracturing subassembly may be releasably coupled to the production subassembly. According to an embodiment, the fracturing subassembly comprises an inlet for receiving fracturing fluids, an outlet coupled to the connection block, and a bore between the inlet and the outlet for communicating a fracturing fluid to a well.

12 Claims, 7 Drawing Sheets

(51) Int. Cl.

| | |
|---|---|
| ***E21B 21/10*** | (2006.01) |
| ***E21B 21/00*** | (2006.01) |
| ***E21B 34/16*** | (2006.01) |

(56) References Cited

U.S. PATENT DOCUMENTS

| | | | | |
|---|---|---|---|---|
| 2008/0230226 | A1* | 9/2008 | Lam | E21B 43/26 166/308.1 |
| 2008/0277120 | A1 | 11/2008 | Hickie | |
| 2010/0051261 | A1* | 3/2010 | Koleilat | E21B 33/068 166/177.5 |
| 2011/0083852 | A1* | 4/2011 | Bertrand | E21B 33/02 166/308.1 |
| 2012/0012341 | A1 | 1/2012 | White et al. | |
| 2012/0097398 | A1* | 4/2012 | Ravensbergen | E21B 43/26 166/308.1 |
| 2012/0152564 | A1 | 6/2012 | Peltier | |
| 2014/0238693 | A1* | 8/2014 | Adkinson | E21B 33/068 166/382 |

OTHER PUBLICATIONS

International Preliminary Report on Patentability issued in PCT Application PCT/US2019/025938 dated Oct. 15, 2020 (9 pages).

* cited by examiner

METHOD AND APPARATUS FOR FRACKING AND PRODUCING A WELL

CROSS-REFERENCE TO RELATED APPLICATION

The present document is based on and claims priority to U.S. Provisional Application Ser. No. 62/653,719, filed Apr. 6, 2018, which is incorporated herein by reference in its entirety.

BACKGROUND

Hydraulic fracturing, commonly referred to as fracking, is a technique used to enhance and increase recovery of oil and natural gas from subterranean natural reservoirs. More specifically, fracking involves injecting a fracking fluid, e.g., a mixture of mostly water and sand, into an oil or gas well at high pressures. The fracking fluid is injected to increase the downhole pressure of the well to a level above the fracture gradient of the subterranean rock formation in which the well is drilled. The high-pressure fracking fluid injection causes the subterranean rock formation to crack. Thereafter, the fracking fluid enters the cracks formed in the rock and causes the cracks to propagate and extend farther into the rock formation. In this manner, the porosity and permeability of the subterranean rock formation is increased, thereby allowing oil and natural gas to flow more freely to the well.

A variety of equipment is used in the fracking process. For example, fracking fluid blenders, fracking units having high volume and high pressure pumps, fracking tanks, and so forth may be used in a fracking operation. Additionally, a fracking tree is generally coupled between the wellhead of a well and the fracking unit. The fracking tree has a variety of valves to control the flow of fracking fluid and production fluid through the fracking tree. A production tree is landed on the wellhead for controlling the production of well fluids. The tree usually carries a choke and valves to control the flow and sensors to monitor the flow.

SUMMARY

In general, a system and methodology are provided for use with a wellhead assembly, mounted over a borehole, to perform well operations. According to an embodiment, the system comprises a modular assembly configured for coupling with the wellhead assembly. The modular assembly may have a production subassembly and a fracturing subassembly. By way of example, the production subassembly may comprise a connection block positioned for coupling to the wellhead assembly, a production outlet fluidly connected to the connection block, and a valve between the connection block and the production outlet. Additionally, the fracturing subassembly may be releasably coupled to the production subassembly. According to an embodiment, the fracturing subassembly comprises an inlet for receiving fracturing fluids, an outlet coupled to the connection block, and a bore between the inlet and the outlet for communicating a fracturing fluid to the well.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate well operations. According to an embodiment, the system comprises a modular assembly configured for coupling with a wellhead assembly mounted over a borehole. In this embodiment the modular assembly has a production subassembly and a fracturing subassembly.

By way of example, the production subassembly may comprise a connection block positioned for coupling to the wellhead assembly. Additionally, a production outlet is fluidly connected to the connection block and a valve is located between the connection block and the production outlet. The fracturing subassembly may be releasably coupled to the production subassembly. According to an embodiment, the fracturing subassembly comprises an inlet for receiving fracturing fluids and an outlet coupled to the connection block. A bore extends between the inlet and the outlet to enable communication of a fracturing fluid to the well.

Figure 1:
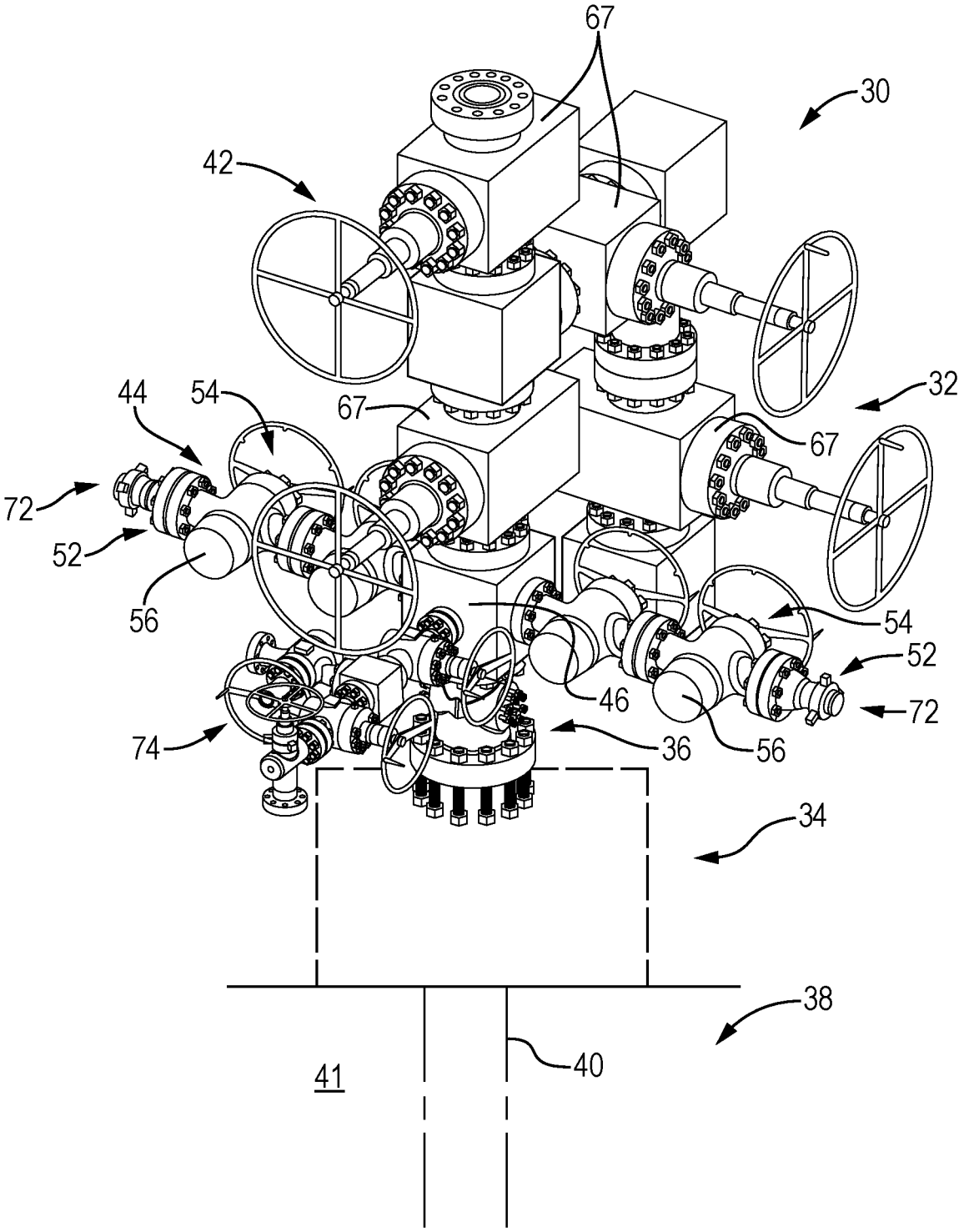
FIG. 1 is an illustration of an example of a modular assembly coupled to a tubing spool of a wellhead assembly, according to an embodiment of the disclosure.

Referring generally to FIG. 1, a well system 30 is illustrated as having a modular assembly 32 which is configured for coupling with a wellhead assembly 34. Depending on the embodiment, the wellhead assembly 34 may comprise or may be combined with at least one tubing spool assembly 36. In the illustrated example, the modular assembly 32 is connected to the wellhead assembly 34 via the tubing spool assembly 36. The wellhead assembly 34 is used in conjunction with a well 38 which may have at least one borehole 40, e.g. a wellbore through which fracturing fluids may be injected and hydrocarbon fluids (or other production fluids) may be produced. The wellhead assembly 34 may be mounted over the borehole 40 as illustrated.

In this example, the modular assembly 32 is constructed to facilitate various well operations such as fracking and producing from the well 38. The modular assembly 32 may be used in a first configuration during, for example, hydraulic fracturing operations. Subsequently, the modular assembly 32 may be transitioned and used in a second configuration during, for example, production operations.

Figure 2:
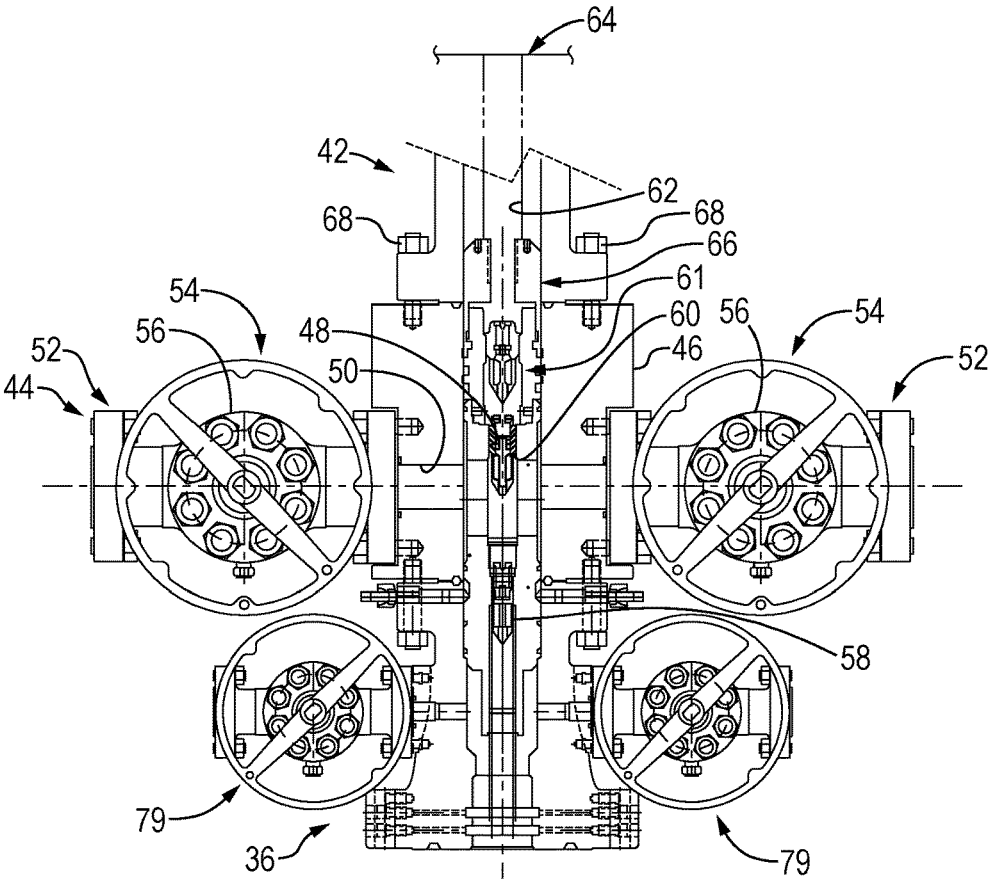
FIG. 2 is a schematic cross-sectional illustration of a portion of the modular assembly, according to an embodiment of the disclosure.

According to the embodiment illustrated, the modular assembly 32 comprises a fracturing subassembly 42 removably mounted to a production subassembly 44 (see also FIG. 2). As a result, the fracturing subassembly 42 may be removed from the modular assembly 32 after fracturing, and the remaining production subassembly 44 may be left in place for production operations. In other words, the modular assembly 32 is transitioned from the first configuration (fracturing configuration) to the second configuration (production configuration).

Hydraulic fracturing, sometimes referred to as fracking, involves injecting a fracking fluid into a borehole, e.g. borehole 40, to create and propagate cracks in a subterranean rock formation 41 located beneath the wellhead assembly 34. In this manner, the porosity and permeability of the rock formation 41 is increased and this leads to enhanced recovery of natural gas and oil from the natural reservoirs beneath the Earth's surface. Traditionally, the fracking fluid was introduced to the well through a frac tree connected to a wellhead.

As discussed in greater detail below, embodiments described herein combine the fracturing subassembly 42 and the production subassembly 44 in modular assembly 32 in a manner which enhances flexibility for a plurality of well operations. In many embodiments, the modular assembly 32 is coupled to a wellhead, e.g. to wellhead assembly 34 which is located above borehole 40. In some embodiments, the tubing spool assembly 36 is part of the wellhead assembly 34 such that the modular assembly 32 is connected to the wellhead assembly 34 via the tubing spool assembly 36. For example, the tubing spool assembly 36 may be mounted on a corresponding main structure of the wellhead assembly 34.

Figure 3:
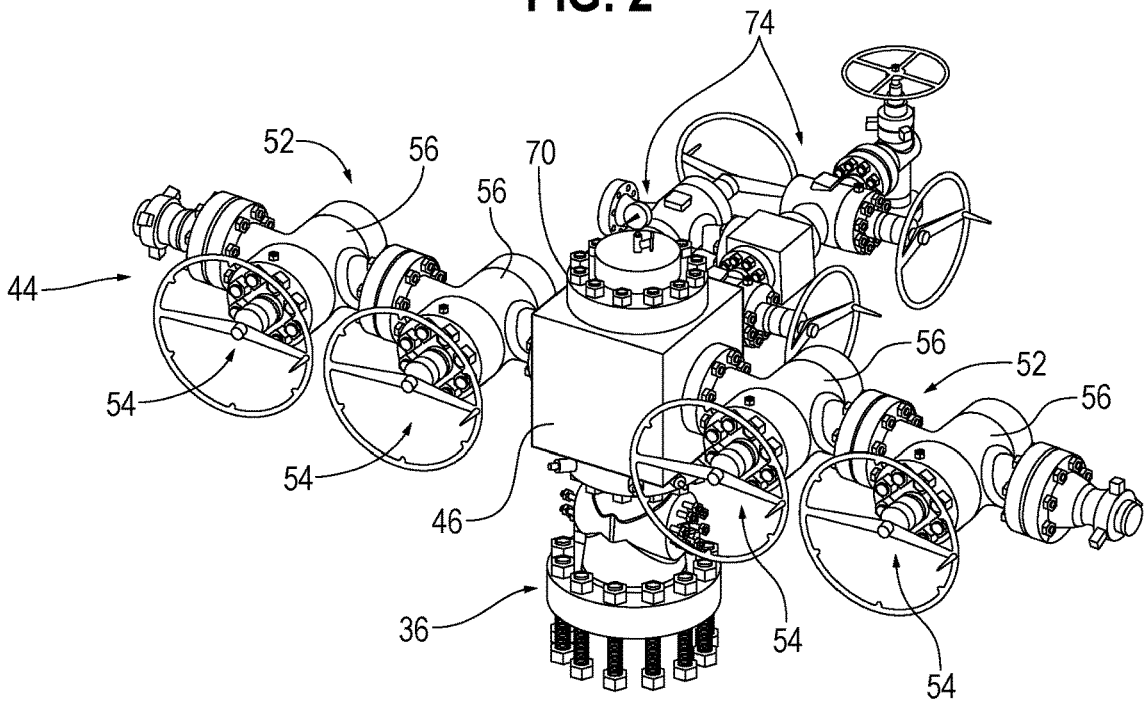
FIG. 3 is another illustration of an example of the production subassembly, according to an embodiment of the disclosure.
Figure 4:
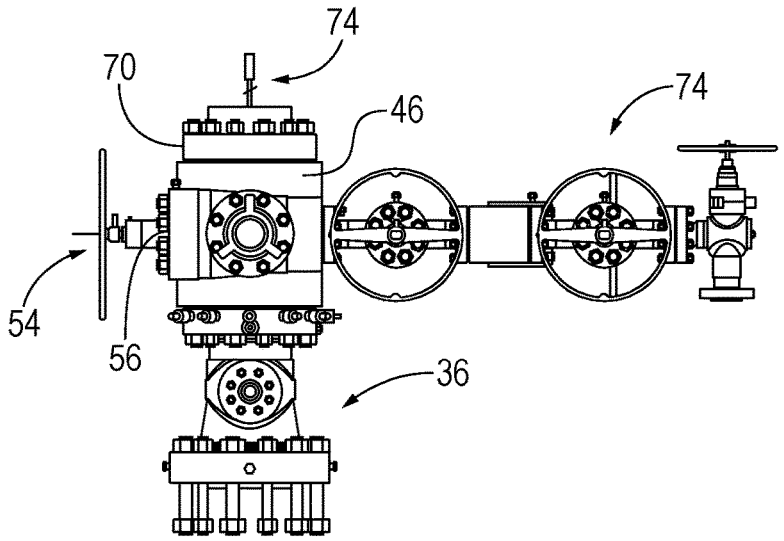
FIG. 4 is an illustration of an example of the production subassembly, according to an embodiment of the disclosure.
Figure 5:
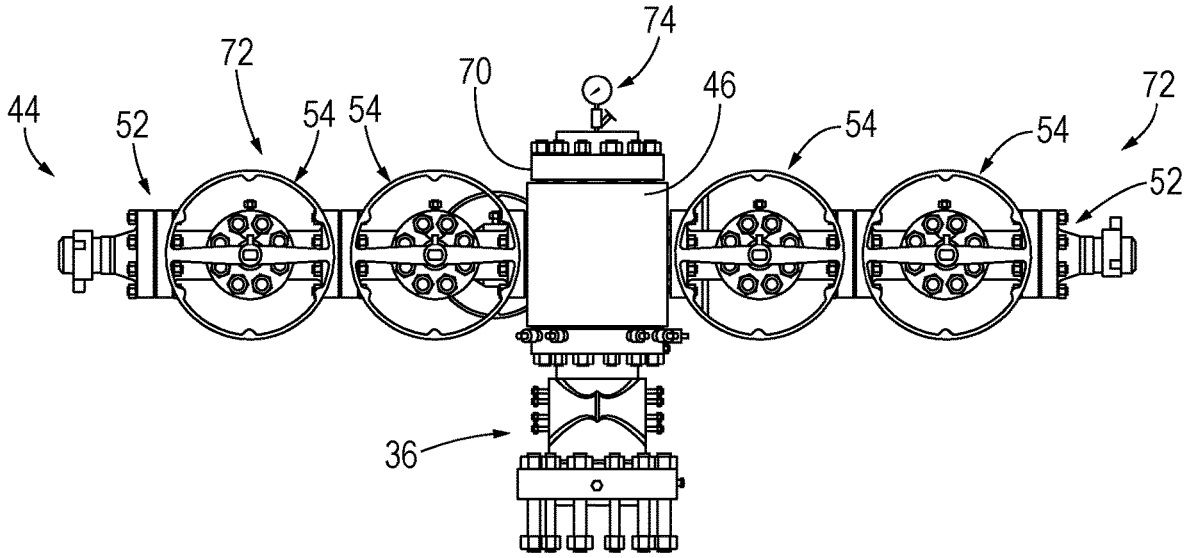
FIG. 5 is another illustration of an example of the production subassembly, according to an embodiment of the disclosure.

Once the modular assembly 32 is coupled with wellhead assembly 34 over borehole 40, the well 38 may be fracked. Upon completion of the fracturing operation, the fracturing subassembly 42 may be removed as illustrated in FIGS. 3, 4 and 5. When the fracturing subassembly 42 is removed, the production assembly 44 remains coupled to the wellhead assembly 34 via, for example, the tubing spool assembly 36. Subsequently, the production process may be initiated to produce hydrocarbon fluids from the subterranean formation while the production assembly 44 remains in place on the wellhead assembly 34.

Referring again to FIGS. 2-5, an embodiment of production subassembly 44 is illustrated. In this embodiment, the production subassembly 44 comprises a connection block 46 which is used to direct fluid flows during both the fracturing operation and the production operation. By way of example, the connection block 46 may comprise conduits through its interior, e.g. a first conduit 48 and a second conduit 50. In the example illustrated, the first conduit 48 and the second conduit 50 intersect each other and are arranged perpendicularly with respect to each other. However, the first and second conduits 48, 50 are not limited to this angular relationship and may be arranged at a variety of other suitable angles for performance of their appropriate functions during fracturing and production operations.

The first conduit 48 provides fluid communication from the fracturing subassembly 42 to the borehole 40. Additionally, the first conduit 48 provides fluid communication from the borehole 40 and back to the fracturing subassembly during flow back operations. The second conduit 50 provides fluid communication to one or more production outlets 52.

At least one flow control device 54, e.g. a valve 56, is positioned in fluid communication with second conduit 50 between the connection block 46 and the corresponding production outlet 52. In various embodiments, a plurality of production outlets 52 and a plurality of flow control devices 54 may be coupled with connection block 46. Each flow control device 54 enables adjustment of flow through the production subassembly 44 including providing a barrier to completely block flow therethrough.

In the illustrated embodiment, a first plug 58 is installed through first conduit 48 and landed on tubing spool assembly 36. However, the first plug 58 may be landed on other components in or associated with the wellhead assembly 34. The first plug 58 serves to prevent flow from the borehole 40 through the first conduit 48. Additionally, a second plug 60 may be installed in the first conduit 48.

With the first plug 58 and the second plug 60 installed, fluid is prevented from flowing through first conduit 48. In particular, fluid communication between the fracturing subassembly 42 and the borehole 40 is prevented by the first and second plugs 58, 60, as illustrated in FIG. 2. The first and second plugs 58, 60 may each be installed through the first conduit 48 of connection block 46. In the example illustrated, second plug 60 also prevents flow down into second conduit 50. According to some embodiments, an additional flow blocking device 61, e.g. a valve or plug, may be located in first conduit 48 above second plug 60.

Figure 6:
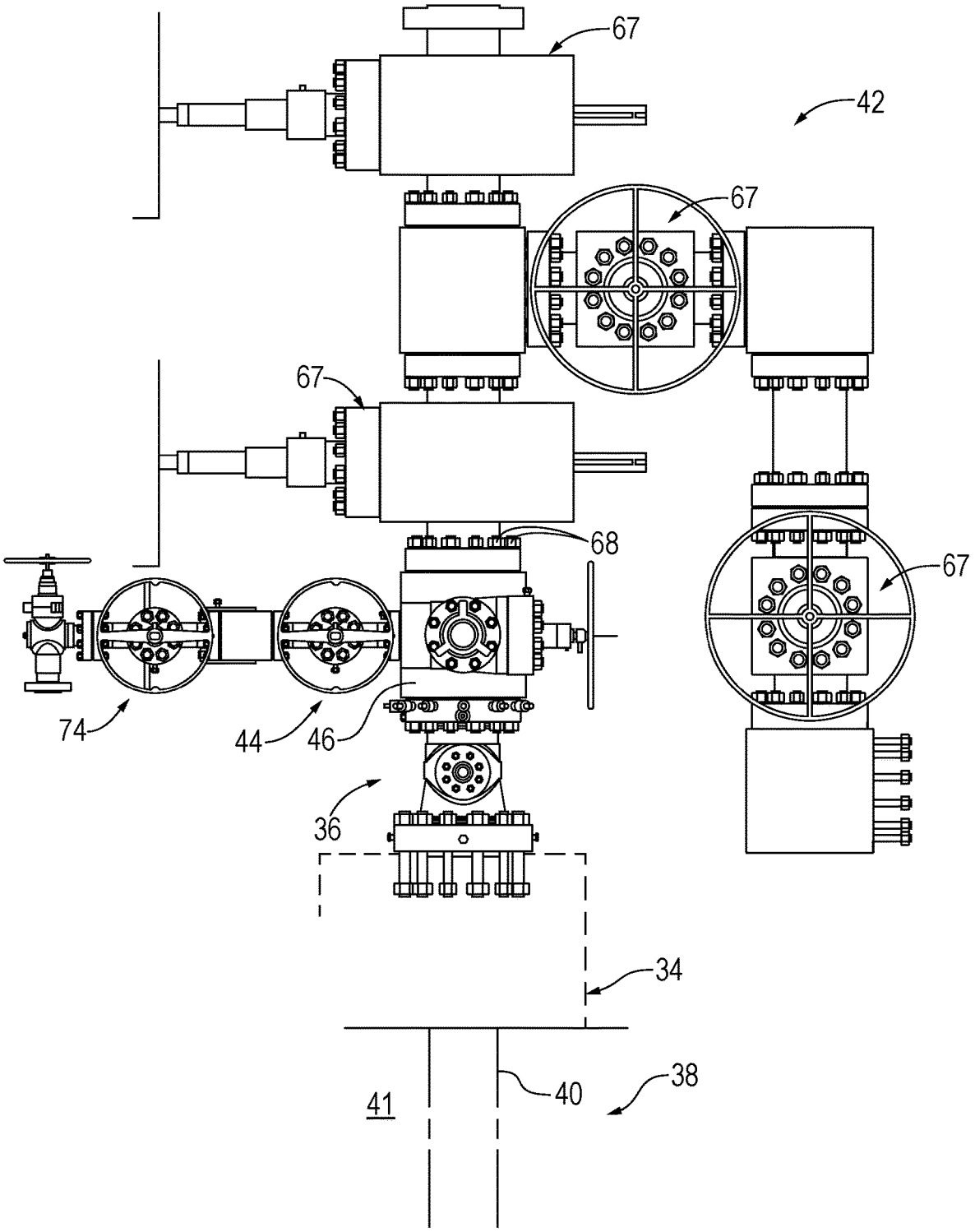
FIG. 6 is an illustration of an example of a modular assembly having a production subassembly and a fracturing subassembly, according to an embodiment of the disclosure.

In FIG. 6, the modular assembly 32 is illustrated with the fracturing subassembly 42 removably installed on production subassembly 44. The first and second plugs 58, 60 may be installed down through the fracturing subassembly 42 and into first conduit 48 of connection block 46 at a suitable time during a given operation. By way of example, the first and second plugs 58, 60 may be installed down through a bore/passage 62 of fracturing subassembly 42 (see FIG. 2). The bore/passage 62 extends between an inlet 64 of the passage 62 and an outlet 66 of the passage 62. The outlet 66 may be coupled with connection block 46 such that passage 62 is in fluid communication with first conduit 48. Once the plugs 58, 60 are installed, no fluid flow from borehole 40 is allowed to enter fracturing subassembly 42. As illustrated, the fracturing subassembly 42 may have a variety of features including valves 67 positioned along subassembly wings or other flow paths.

Installation of plugs 58, 60 enables removal of the fracturing subassembly 42 from the production subassembly 44 so that the fracturing subassembly may be relocated to another wellbore, returned to inventory, refurbished, or otherwise utilized. It should be noted the fracturing subassembly 42 may be releasably coupled to production subassembly 44 via fasteners 68, e.g. bolts, or other suitable attachment mechanisms.

Once the fracturing subassembly 42 is removed, a blind flange 70 or other suitable device may be coupled to the production subassembly 44 (see FIGS. 3-5). The blind flange 70 prevents fluid flow through the first conduit 48. Prior to placing the blind flange 70, the first and second plugs 58, 60 may be removed to enable flow through the production subassembly 44, e.g. flow to production outlets 52. However, other techniques may utilize plugs 58, 60 which can be removed after placement of the blind flange 70, e.g. removal through the blind flange 70 or through other passages. In some embodiments, the plugs 58, 60 may be lubricated to facilitate removal and then removed to permit the desired fluid flow. Removal of plugs 58, 60 enables fluid flow from the borehole 40, into connection block 46, through second conduit 50, and out through at least one production outlet 52.

Depending on the specifics of a given operation, the production assembly 44 may comprise various production outlets 52 and corresponding flow control devices 54 arranged along wings 72 extending outwardly from the connection block 46. Various numbers of flow control devices 54 and/or other components may be located along wings 72 (see, for example, FIG. 5). Additionally, the modular assembly 32, wellhead assembly 34, and/or spool assembly 36 may comprise a variety of other features 74 to facilitate desired aspects of the fracturing and/or production operations.

In an operational example, the fracturing subassembly 42 in combination with connection block 46 of production subassembly 44 is used to enable pumping of high-pressure fracturing fluid down into borehole 40 formed in the subterranean rock formation 41. In many applications, the well 38 is in the form of a natural gas and/or oil well.

The fracturing subassembly 42 is coupled to the production subassembly 44, and the production subassembly 44 is coupled to the wellhead assembly 34, e.g. via one or more tubing spool assemblies 36. In some embodiments, the fracturing subassembly 42 also may be coupled to a manifold system (not shown). In such an embodiment, fracturing fluid may be introduced to the fracturing subassembly 42 through the manifold system. Regardless of the use of the manifold system, the fracturing fluid is received via the inlet 64 of fracturing subassembly 42. From inlet 64, the fracturing fluid moves down through bore/passage 62 and out through the outlet 66 of the fracturing subassembly 42.

After the fracturing fluid is directed through the fracturing subassembly 42, the fracturing fluid moves through the connection block 46 (via first conduit 48) of production subassembly 44. The flowing fracturing fluid continues to flow out of the connection block 46 and into the tubing spool assembly 36, if a tubing spool assembly 36 is utilized. From the tubing spool assembly 36, the fracturing fluid flows down through the wellhead assembly 34 and into the appropriate fracturing equipment positioned in borehole/wellbore 40. It should be noted the wellbore 40 may be perforated to facilitate flow of the fracturing fluids into the surrounding formation 41.

Once the fracturing operation is completed, flow back of the well 38 may be initiated. During the flow back operation, fluids from the borehole 40 are flowed up through the wellhead assembly 34 and through the modular assembly 32. For example, the flow back fluids may be flowed up through the connection block 46 of the production subassembly 44 and up through the fracturing subassembly 42 via passage 62. After completion of the flow back operation, the plugs 58 and/or 60 may be deployed down through the fracturing subassembly 42 and landed in the production subassembly 44 and/or cooperating component to block flow along first conduit 48. Once flow along first conduit 48 is blocked, the fracturing subassembly 42 may be uncoupled, e.g. unbolted, from the production subassembly 44 and removed. The blind flange 70 may be coupled to the production subassembly 44 to prevent fluid flow through the first conduit 48. Additionally, the first and second plugs 58, 60 may be lubricated and removed to permit fluid flow through the production subassembly 44 and out through the one or more production outlets 52.

It should be noted the modular assembly 32 is configured for use in both fracturing and production operations with respect to a given well 38. The modular assembly 32 may be configurable with a variety of additional features. For example, a goat head (not shown) may be attached to the modular assembly 32, e.g. to the production subassembly 44. A goat head is a term which refers to a flow cross which may be installed on the modular assembly 32. Other features may include production tubing run through the modular assembly 32.

Figure 7:
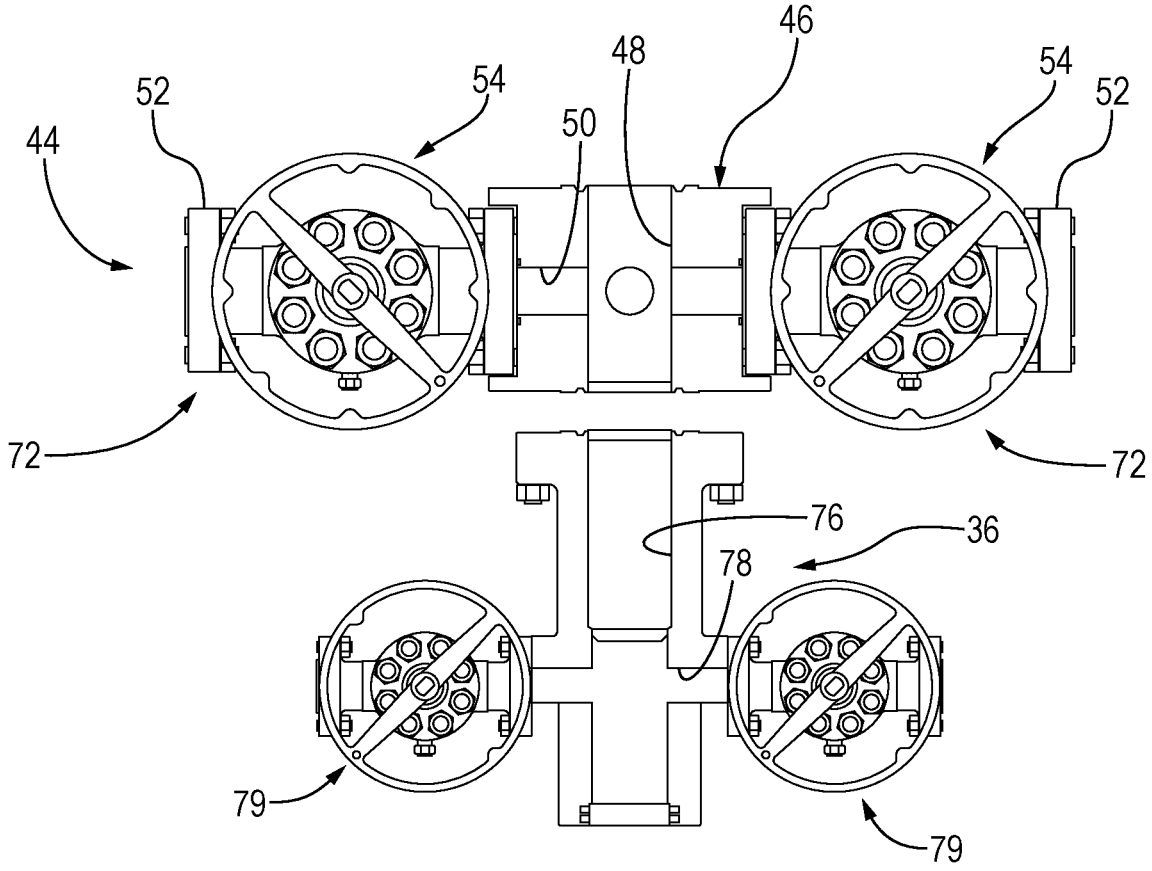
FIG. 7 is an illustration of an example of a combination spool assembly, according to an embodiment of the disclosure.

As further illustrated in FIG. 7, for example, the tubing spool assembly 36 and the connection block 46 may be pre-fabricated prior to transporting these components of the modular assembly 32 to a worksite. In this example, the tubing spool assembly 36 comprises a generally vertical passage 76 intersected by a lateral passage or passages 78 which may be in fluid communication with corresponding wings 79 having suitable valves, couplers, and/or other flow control equipment. The generally vertical passage 76 may be in fluid communication with first conduit 48 of connection block 46. The passage 76 and the first conduit 48 may be sized to receive production tubing therethrough.

Figure 8:
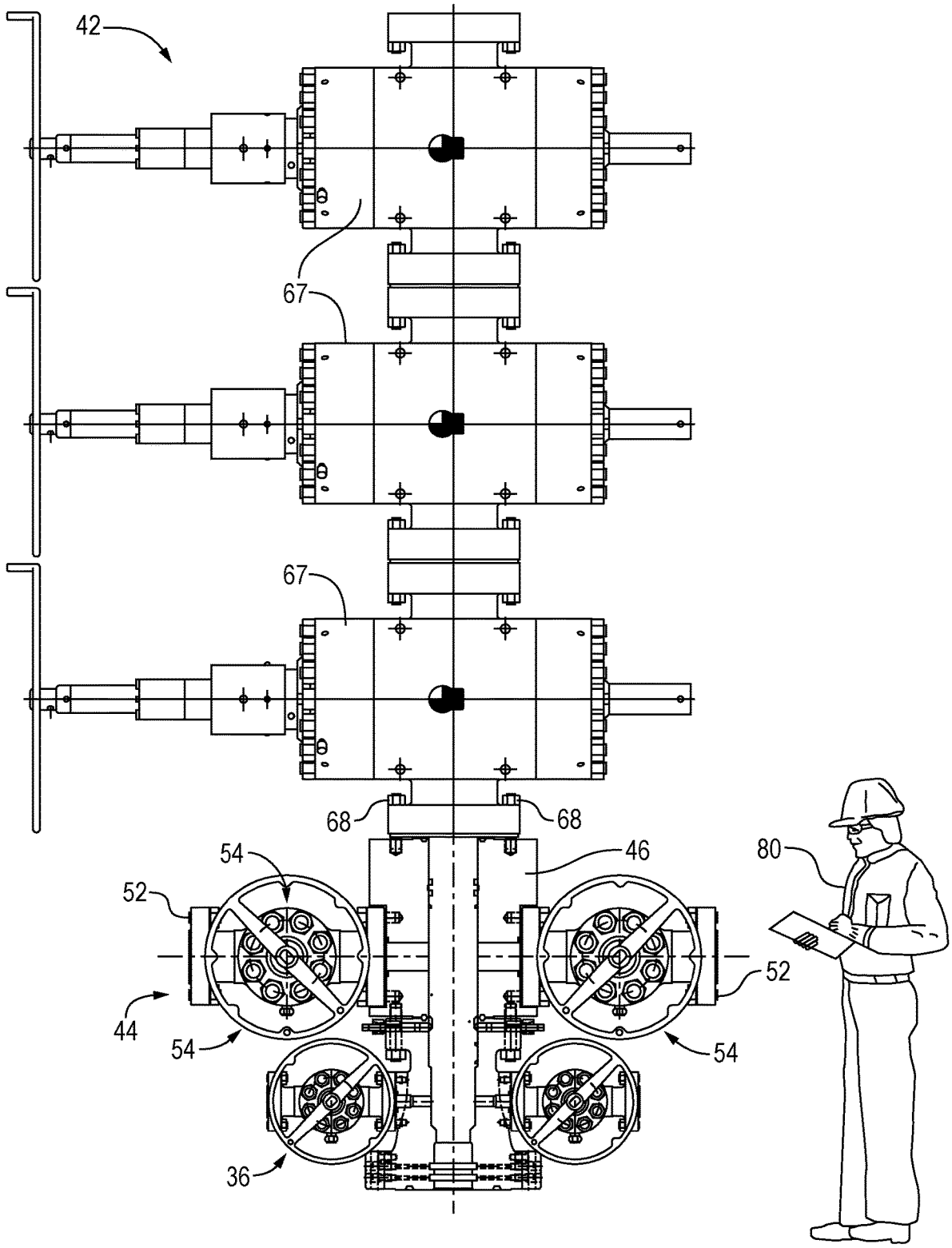
FIG. 8 is a schematic view of an example of the modular system showing its relatively compact size, according to an embodiment of the disclosure.
Figure 9:
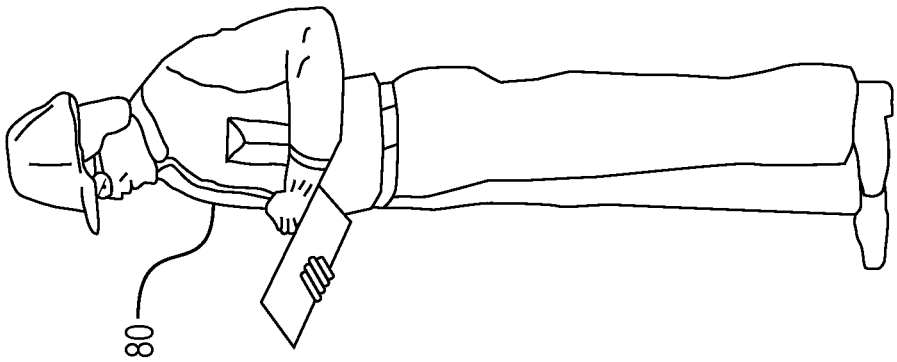
FIG. 9 is a schematic view of an example of the production subassembly, according to an embodiment of the disclosure.
Figure 9:
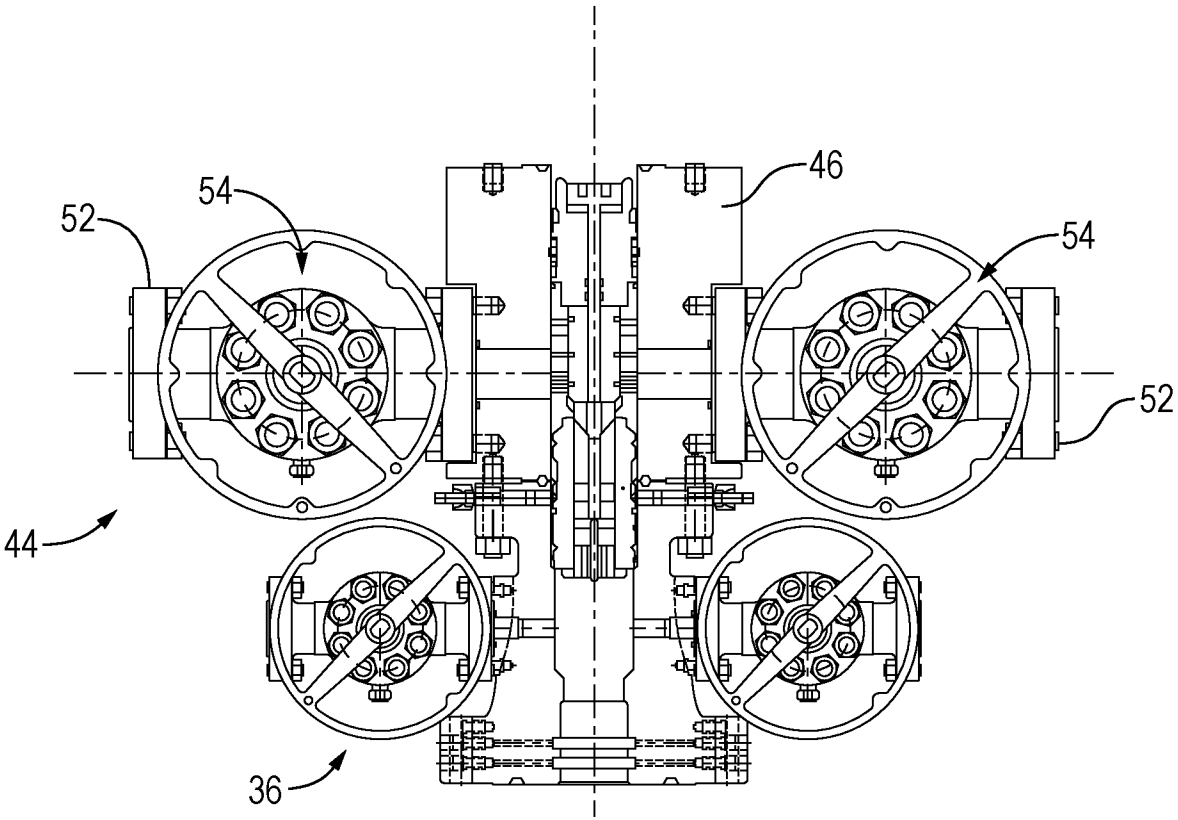

In a variety of applications, the configuration of the modular assembly 32 enables construction of the modular assembly 32 with a relatively reduced height, as illustrated in FIG. 8. In particular, the height of the production subassembly 44 may be reduced relative to traditional production trees, as represented in FIG. 9. In FIGS. 8 and 9, a schematic representation of a well operator 80 is shown to provide an example of relative heights of the production subassembly 44 and the overall modular assembly 32. In some embodiments, the overall modular assembly 32 may be less than two and a half times the height of the well operator 80 (see FIG. 8) while the production subassembly 44 may be substantially less than the height of the well operator 80 (see FIG. 9).

According to an embodiment of well system 30, the production subassembly 44, including the connection block 46, is coupled to the well 38, e.g. coupled to the wellhead assembly 34 via the tubing spool assembly 36. The fracturing subassembly 42 is then coupled to the connection block 46 and placed in fluid communication therewith. Fracturing fluid is transmitted through the fracturing subassembly 42 and through the connection block 46 to the wellbore 40 of well 38. After fracturing, flow back fluids are flowed from the wellbore and up through the fracturing subassembly 42. A well barrier, e.g. at least one of the plugs 58, 60, may then be installed to prevent fluid communication from the well 38 to the fracturing subassembly 42. The fracturing subassembly 42 is then removed. This allows production fluid to be transmitted from the well 38, through the production subassembly 44, through at least one production outlet 52, and to a desired collection location.

In some embodiments, a well barrier may be inserted while the borehole 40 is under pressure. The well barrier may be in the form of plugs, e.g. plugs 58, 60, or other suitable well barrier. Additionally, a valve may be provided upstream of the well barrier and subsequently removed. In some embodiments, the modular assembly 32 may be constructed such that the well barrier may be maintained in place while the flow back flow from the formation is flowing up through the modular assembly 32. Some types of well barriers may be selectively opened or closed to control the flow of flow back fluids.

Various numbers of plugs 58, 60 and/or other flow control devices 61 may be installed into and/or through the connection block 46 to block fluid communication from the well 38 and through the connection block 46. The plug or plugs 58, 60 may be removed to enable production flow from the formation by, for example, lubricating the plug(s) or via other suitable plug removal techniques. After removal of the plugs 58, 60 and/or other well barrier, production tubing may be run through the fracturing subassembly 42 and through the production subassembly 44 into wellbore 40. The production tubing may be suspended in a suitable device such as a tubing head bowl. After the production tubing is suspended, a suitable well barrier may be installed or reinstalled at a suitable position to facilitate production operations.

In some applications, the production subassembly 44 may comprise or may be in the form of a horizontal production tree having a wing valve. For example, at least one of the valves 56 may be in the form of a wing valve. Removal of the plug or plugs 58, 60 may involve lubricating the plug(s) through the wing valve 56. The wing valve 56 may then be removed to enable installation of a blind flange or other suitable device in place of the wing valve, thus blocking flow. As discussed above, a goat head may be installed on the modular assembly 32 and, in some applications, the goat head does not include a wing valve. Additionally, sliding sleeves may be used in or below the modular assembly 32, and the sliding sleeve or sleeves may be selectively opened to expose the surrounding formation to the wellbore 40. In a variety of applications, the wellbore 40 and the surrounding formation may be perforated to facilitate fracking operations and production operations.

It also should be noted that in some applications, the production subassembly 44 may be located subsurface in, for example, a cellar so that it is not visible above ground. The modular assembly 32 may be used in a variety of fracturing and production operations with many types of wells including wells having generally vertical and/or deviated wellbore sections. Additionally, various other types of features may be combined with components of the modular assembly 32 to facilitate other aspects of the well related operations. The number of wings, valves, plugs, and/or other components may be adjusted according to the parameters of a given operation. Similarly, the size of the components as well as the internal passages of the components may be selected to accommodate parameters of a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for performing well operations at a well, the method comprising:

coupling a production subassembly to the well, wherein the production subassembly includes a connection block;

coupling a fracturing subassembly to the connection block and in fluid communication therewith;

transmitting fracturing fluid through the fracturing subassembly and the connection block to a wellbore of the well;

flowing back fluids in the wellbore through the fracturing assembly;

installing a well barrier while the wellbore is under pressure to prevent fluid communication from the well to the fracturing subassembly;

running production tubing through the fracturing subassembly and the production subassembly into the wellbore;

suspending the production tubing removing the fracturing subassembly; and transmitting production fluid from the well through the production subassembly.

2. The method as recited in claim 1, further comprising providing a valve in combination with the well barrier; and subsequently removing the valve.

3. The method as recited in claim 2, further comprising maintaining the well barrier in place while the flow back flow from the formation is flowing.

4. The method as recited in claim 1, further comprising opening or closing the well barrier to control the flow back flow.

5. The method as recited in claim 1, further comprising: removing the well barrier.

6. The method as recited in claim 1, further comprising opening a sliding sleeve to expose the wellbore to a formation surrounding wellbore.

7. The method as recited in claim 1, further comprising perforating the wellbore.

8. A method for performing well operations at a well, the method comprising:

coupling a production subassembly to a production tree having a wing valve, wherein the production subassembly includes a connection block;

installing a plug through the connection block to block fluid communication through the connection block from the well coupling a fracturing subassembly to the connection block and in fluid communication therewith;

transmitting fracturing fluid through the fracturing subassembly and the connection block to a wellbore of the well;

flowing back fluids in the wellbore through the fracturing assembly;

installing a well barrier to prevent fluid communication from the well to the fracturing subassembly;

removing the fracturing subassembly;

transmitting production fluid from the well through the production subassembly;

lubricating the plug through the wing valve;

removing the wing valve; and installing a blind flange where the wing valve was removed.

9. The method as recited in claim 8, further comprising removing the plug to enable a production flow from a formation surrounding the wellbore.

10. The method as recited in claim 8, wherein the production tree is a horizontal production tree including the wing valve.

11. A method for performing well operations at a well, the method comprising:

coupling a production subassembly to a wellhead assembly via a connection block able to transmit production fluid;

coupling a fracturing subassembly to the connection block;

transmitting fracturing fluid through the fracturing subassembly and the connection block to a wellbore of the well;

flowing back fluids in the wellbore through the fracturing assembly;

installing a well barrier while the wellbore is under pressure to prevent fluid communication from the well to the fracturing subassembly to enable removal of the fracturing subassembly;

running a production tubing through the fracturing subassembly and the production subassembly into the wellbore;

suspending the production tubing; and removing the fracturing subassembly.

12. The method as recited in claim 11, further comprising installing a plug through the connection block to block fluid flow from the well through the connection block.

* * * * *